US006138491A

United States Patent [19]

Grewal et al.

[11] Patent Number: 6,138,491

[45] Date of Patent: Oct. 31, 2000

[54] APPARATUS AND METHOD FOR LOW HEAT TRANSFER RATE CHILL DOWN DURING FORGING

[75] Inventors: Sukhminder S. Grewal, New Haven, Conn.; Stephen R. Demichele, Pittsford; Richard L. Couture, Castleton, both of Vt.

[73] Assignee: General Electric Company, Cincinnati, Ohio

[21] Appl. No.: 09/340,266

[22] Filed: Jun. 25, 1999

[51] Int. Cl.[7] ..... B21J 13/10

[52] U.S. Cl. ..... 72/420; 72/342.5; 72/361; 72/364; 72/465.1; 29/889.7

[58] Field of Search ..... 72/352, 358, 359, 72/361, 465.1, 466.8, 466.9, 364, 419, 420, 295, 296, 298, 301, 344, 351, 342.5; 29/889, 889.6, 889.7

[56] References Cited

U.S. PATENT DOCUMENTS

| | | | |
|---|---|---|---|
| 2,382,339 | 8/1945 | Skowron et al. . | |
| 3,988,913 | 11/1976 | Metcalfe et al. . | |
| 4,033,168 | 7/1977 | Fisk | 72/344 |
| 4,055,975 | 11/1977 | Serfozo et al. . | |
| 4,222,260 | 9/1980 | McDermott | 72/364 |
| 4,321,818 | 3/1982 | Bessho . | |
| 4,444,039 | 4/1984 | Asari et al. | 72/342.5 |
| 4,466,266 | 8/1984 | Gardner et al. . | |
| 4,479,293 | 10/1984 | Miller et al. . | |
| 4,527,410 | 7/1985 | MacNitt, Jr. et al. . | |
| 4,665,785 | 5/1987 | Thurner . | |
| 4,712,404 | 12/1987 | Crout et al. . | |
| 5,933,951 | 8/1999 | Bergue et al. | 29/889.72 |

FOREIGN PATENT DOCUMENTS

| | | | |
|---|---|---|---|
| 1227307 | 4/1986 | U.S.S.R. | 72/361 |

OTHER PUBLICATIONS

"Custom Trim Presses", Metal Machanics, Inc., http://www.metalmechanics.com, Jun. 1, 1999.

*Primary Examiner*—Ed Tolan

*Attorney, Agent, or Firm*—Andrew C. Hess; Gerry S. Gressel

[57] ABSTRACT

The invention includes methods and apparatus for forging and may be applied to trim processes using trim presses. Included are methods and apparatus for forging a gas turbine engine blade forging from a pre-formed workpiece having in serial relationship root, platform, and airfoil sections. A forge press includes a lower die and an upper die and the workpiece has a workpiece contact surface area for contacting a die contact surface area of the upper die during impact of the upper die against the workpiece. A workpiece is heated to a first temperature above an impact temperature, the workpiece is placed on the lower die such that the workpiece contact surface area is in an elevated position above the die contact surface area during chill down, and the ram is actuated to effect impacting of the upper die against the workpiece and contact between the workpiece contact surface area and the die contact surface area during the impacting. One embodiment includes spacing the workpiece contact surface area above the die contact surface area with a collapsible means that collapses during the impacting allowing the contact between the workpiece contact surface area and the die contact surface area during the impacting.

23 Claims, 6 Drawing Sheets

APPARATUS AND METHOD FOR LOW HEAT TRANSFER RATE CHILL DOWN DURING FORGING

FIELD OF THE INVENTION

The present invention relates to the hot forming or forging of metals and, more particularly, in one aspect to methods and apparatus for forming metals which are difficult to process by conventional methods as well as those more readily formed metals. The term metal, as used herein, includes both elemental metals and alloys unless indicated otherwise.

DESCRIPTION OF RELATED ART

Numerous methods for the solid state forming of metallic workpieces or blanks into selected shapes include forging and rolling. Press forging is a widely used technique in which the metal is worked at an elevated temperature such as for the formation of gas turbine engine blade airfoils. In a typical forging operation, an unformed workpiece is preheated to forging temperature and then shaped with a hammer or ram of a forge press. The unformed workpiece is typically a pre-form having an approximate shape to that of the formed workpiece.

The hot forming or forging process requires a heated workpiece at a high temperature, typically, above 1700° F. The forge dies, though often heated, are at a much lower temperature, typically, less than 500° F. or even at room temperature. The large temperature differential and the high thermal diffusivity of the metals being forged causes a rapid heat transfer. The temperature of the workpiece in contact with the die drops in temperature at 100° F. per second or more. The thinner the workpiece the larger the relative effect of this temperature drop is. In the absence of any other reheating methods, the temperature of the workpiece continues to fall in a transient way until the ram of forge press impacts the upper die against the workpiece. Afterwards, the workpiece temperature continues to fall until the workpiece is removed from contact with the metal die or until it reaches the same temperature as the die.

The physical properties of the workpiece material at time of impact of the forge press on the workpiece are a strong function of the temperature at time of impact. These physical properties contribute to the results of the forging process in terms of extent of deformation achieved with a specific forge force as well as the flow of material caused by the forge forces. In addition, there is heat generated in the material during deformation caused by the plastic deformation which also effects the results of the forging process.

The conditions of the workpiece at the exact instant of impact by the ram are determined by the transient temperature distribution through the workpiece, which in turn, is determined by the heat transfer from the workpiece to the die. The heat transfer depends on two parameters, (1) the heat transfer coefficient or resistance to the heat transfer from the workpiece to the die,and (2) the time of contact with the colder die during which the heat transfer takes place.

Variations in these two parameters during the forging process effect repeatability of the processes and, hence, the consistency of the parts that are forged. The variation in the heat transfer coefficient and the time of contact causes substantial variations between parts in the temperature profile in the workpiece and, thereby, causes variation in the shape, form, and content of the product. This variation is significant because the precision required in gas turbine engine and, in particular, aircraft gas turbine engine airfoils. There is also variation in the residual stress in the material that can cause variation in subsequent machining operations.

Various corrective actions are currently used in forge shops to reduce these variations. Adjustments of other press and forming parameters, benching and changing the shape of the dies, subsequent cold working and hot working, and chemical metal removal are all used to reduce part-to-part variation to meet tolerance requirements. These corrective operations increase the cost of production and inventory and also increase the cycle time for making the part.

Another factor that effects repeatability or part-to-part variation is the additional variability due to operators working at different speeds and variations during the shift of same operator. These differences cause both the time of contact and the heat transfer coefficient to vary with consequent variation in the part geometry. There is a need to reduce part-to-part variation in the forging process using presses and improve consistency of hot formed parts made with forge presses.

SUMMARY OF THE INVENTION

The invention includes methods and apparatus for forging and, in a more particular application, to the forging of gas turbine engine blade forgings having in serial relationship root, platform, and airfoil sections. The invention is applicable to hot forged parts and is particularly applicable to forging critically thin sections. A method for forging a workpiece uses a forge press, the press having a lower die and an upper die, the upper die connected to a ram, and the workpiece having a workpiece contact surface area for contacting a die contact surface area of the lower die during impact of the upper die against the workpiece. The method includes heating a workpiece to a first temperature above an impact temperature, placing the workpiece on the lower die such that the workpiece contact surface area is in an elevated position above the die contact surface area, and actuating the ram to effect impacting of the upper die against the workpiece and contact between the workpiece contact surface area of the workpiece and the die contact surface area of the lower die during the impacting. One embodiment of the invention includes spacing the workpiece contact surface area above the die contact surface area with a collapsible means that collapses during the impacting allowing the contact between the workpiece contact surface area and the die contact surface area during the impacting. Another embodiment provides protuberances on the workpiece contact surface. Preferably, the protuberances are pre-formed on the workpiece contact surface area prior to the heating. In another embodiment, the collapsible means is a spring-loaded apparatus on the lower die. In a more particular embodiment, the spring-loaded apparatus has at least one spring-loaded assembly wherein the assembly has a shaft disposed in a bore in the lower die and a spring disposed in the bore between the shaft and a bottom surface of the bore.

In one other embodiment, the workpiece is for a gas turbine engine blade forging and is a pre-form having a base section including a platform and an airfoil section extending away from the platform section. The airfoil section includes the workpiece contact surface area and the placing of the workpiece on the lower die includes pivotably resting the platform section on the lower die and spacing the workpiece contact surface area above the die contact surface area.

An apparatus for forming a workpiece includes a press having spaced apart lower and upper dies, the press having a ram operably connected to the upper die, the workpiece having a workpiece contact surface area, the lower die having a die contact surface area for contacting a die contact surface area of the lower die during impact of the upper die against the workpiece, and a device for maintaining the workpiece in an elevated position above the lower die such that most of the workpiece contact surface area is in an elevated position above the die contact surface area. In one embodiment, the device for maintaining the workpiece in an elevated position is a collapsible element that collapses during the impact allowing the contact between the workpiece contact surface area and the die contact surface area during the impacting. In a more particular embodiment, the collapsible element includes one or more preferably pre-formed protuberances on the workpiece contact surface. In another embodiment, the device for maintaining the workpiece in an elevated position is at least one spring-loaded means between the workpiece and the lower die such as a shaft disposed in a bore in the lower die and a spring disposed in the bore between the shaft and a bottom surface of the bore.

ADVANTAGES

The main advantages of the present invention is to make forging processes more repeatable so that the parts that are forged are more consistent. The invention reduces variation in the shape and form of parts and is particularly significant to meet the precision required in the production of aviation airfoils. It replaces various corrective actions that are currently used in forge shops to reduce part-to-part variation to meet tolerance requirements. These actions include; adjustments of other press and forming parameters, benching and changing the shape of the dies, subsequent cold working and hot working, and chemical metal removal. These subsequent corrective operations increase the cost of production and inventory and also increase the cycle time for making the part.

The present invention reduces the heat transfer rate (heat transfer coeff.) for the chill down of the hot workpiece on the cold die. The result is a reduced sensitivity to timing and other variations in the forging process. The result is reduced part-to-part variations in shape, relative orientation between workpiece features or sections, and internal residual stresses of the formed part.

The present invention reduces part-to-part variation due because of additional variability due to operators working at different speeds and variation during the shift of same operator.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
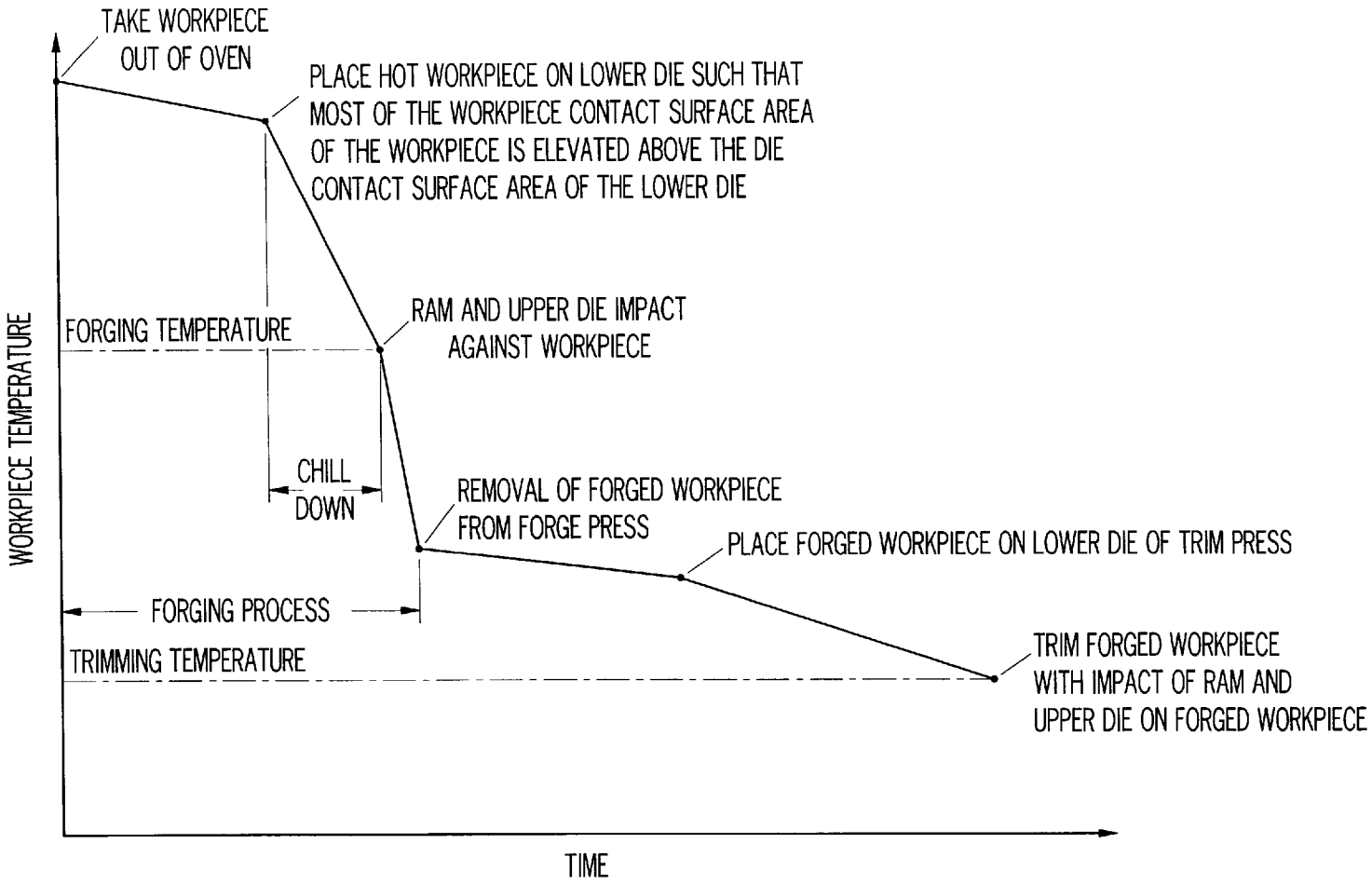
FIG. 1 is a graphical illustration of a method for forming and trimming a workpiece using an exemplary embodiment of the present invention.
Figure 2:
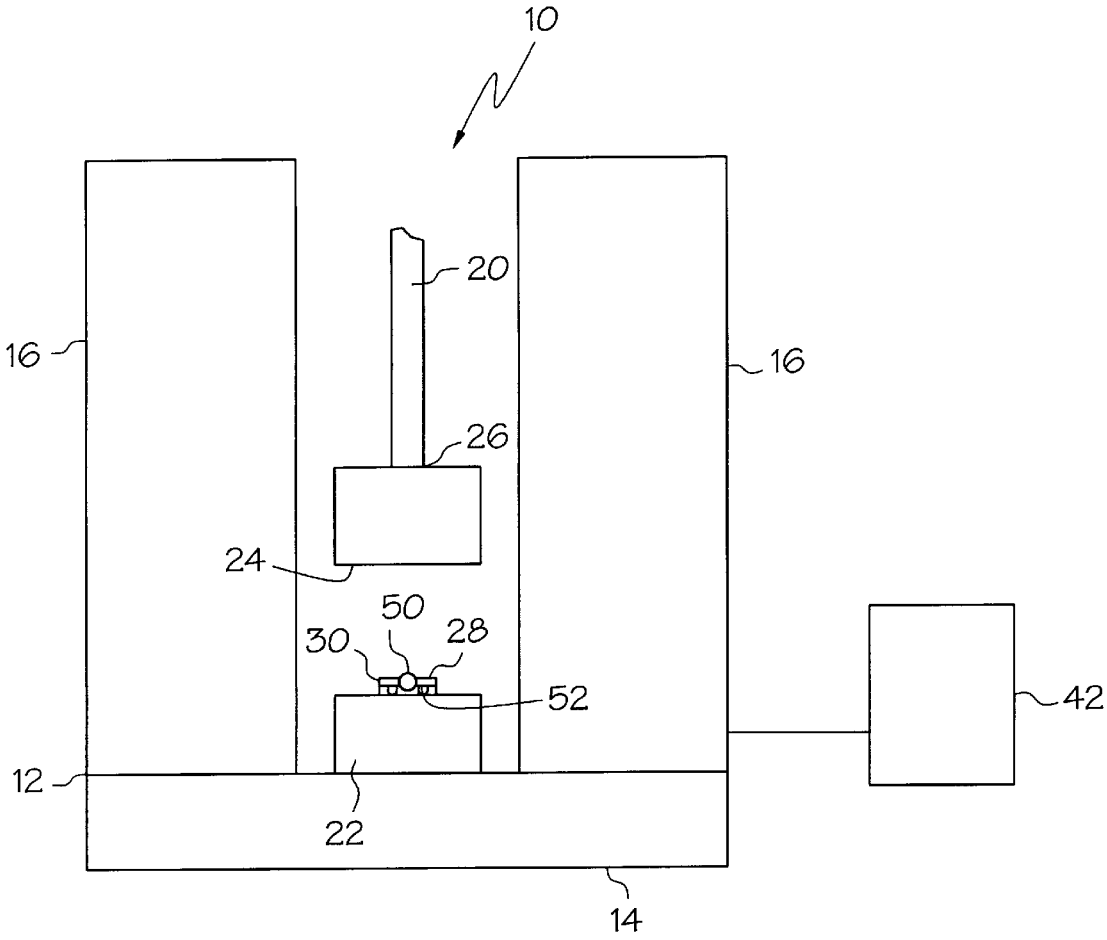
FIG. 2 is a front view schematical illustration of an exemplary embodiment of a forge press apparatus of the present invention.

The invention includes methods as graphically illustrated in FIG. 1 for operating a forge press 10 schematically illustrated in FIG. 2. The press 10 has a frame 12 with a base 14 on the bottom of the frame and columns 16 extending upward that support a ram 20 operable to quickly move linearly in a downwardly direction with a great deal of force. A lower die 22 rests fixedly supported on the base 14 and an upper die 24 is mounted on a bottom portion 26 of the ram 20. A hot pre-formed or unformed workpiece 28 placed on the lower die 22 is impacted by the upper die 24 when the ram 20 is actuated.

Figure 7:
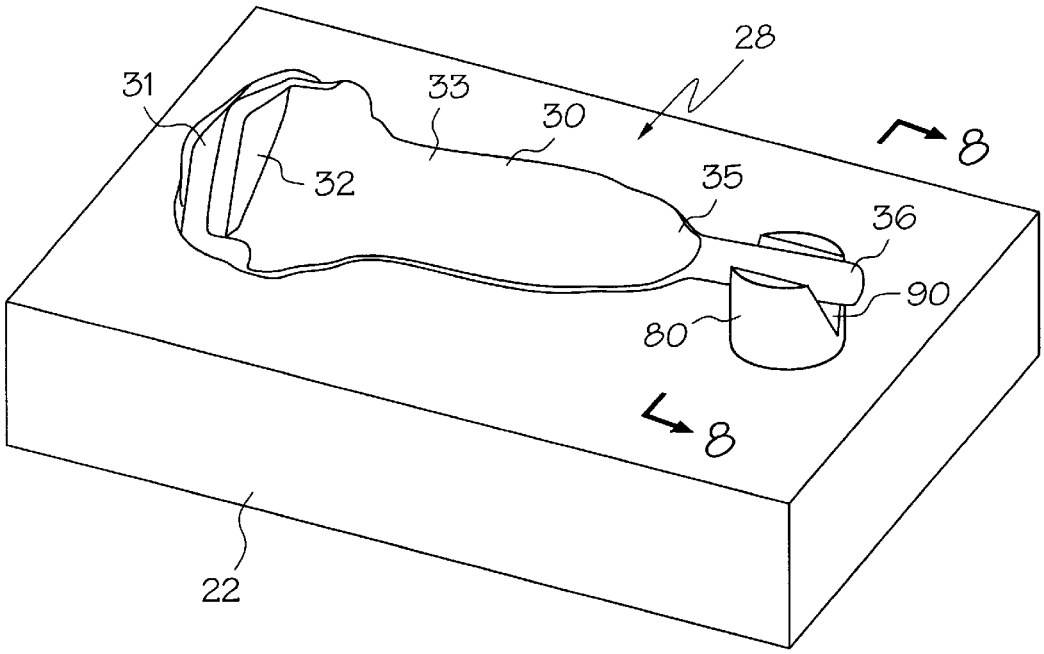
FIG. 7 is a perspective view illustration of the blade in FIGS. 4 and 5 elevated above the lower die in FIG. 2 using a spring loaded shaft in the lower die.

As illustrated in FIG. 7, the workpiece 28 is exemplified by a gas turbine engine compressor blade pre-form 30 which is pre-formed from cylindrical bar stock to have in serial relationship root, platform, and airfoil sections 31, 32, and 33, respectively. The airfoil section 33 extends from the platform section 32 of the blade workpiece or pre-form 30 to a tip 35 of the blade workpiece. A cylindrical bar extension 36 extends away from the tip 35. The cylindrical bar extension 36 is left over from a pre-forging operation that forms the blade workpiece or pre-form 30 including the root, platform, and airfoil sections 31, 32, and 33, respectively. The present invention forms a blade forging from the pre-form and the blade forging is then machined and further processed into a final form of a blade for installation into a gas turbine engine.

Figure 3:
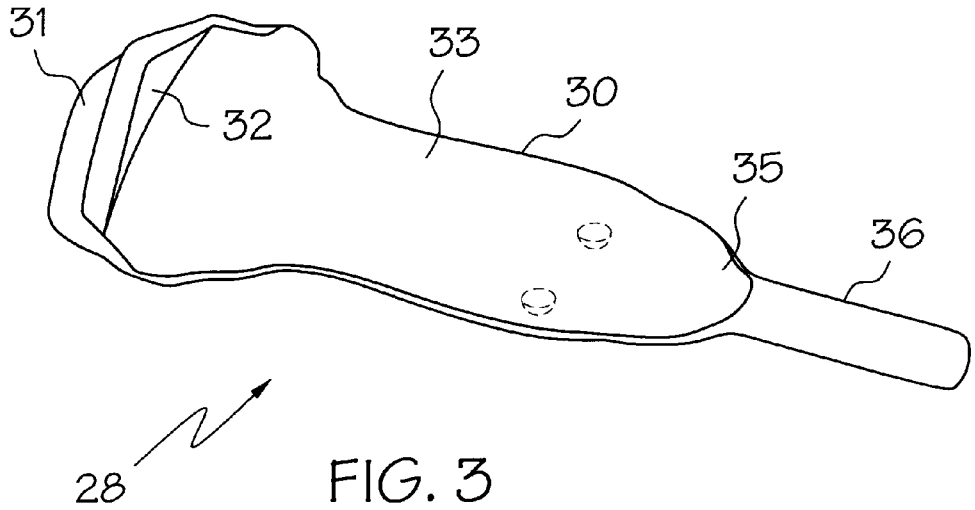
FIG. 3 is a top view perspective illustration of gas turbine engine blade forging pre-form exemplifying a workpiece used in the present invention as illustrated in FIG. 1.
Figure 4:
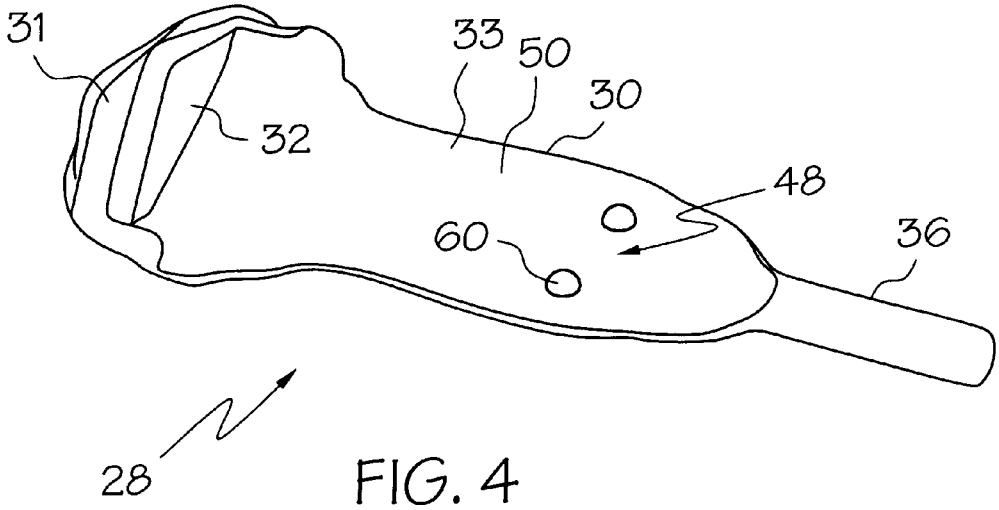
FIG. 4 is a bottom view perspective illustration of gas turbine engine blade forging pre-form exemplifying a workpiece used in the present invention as illustrated in FIG. 1.
Figure 9:
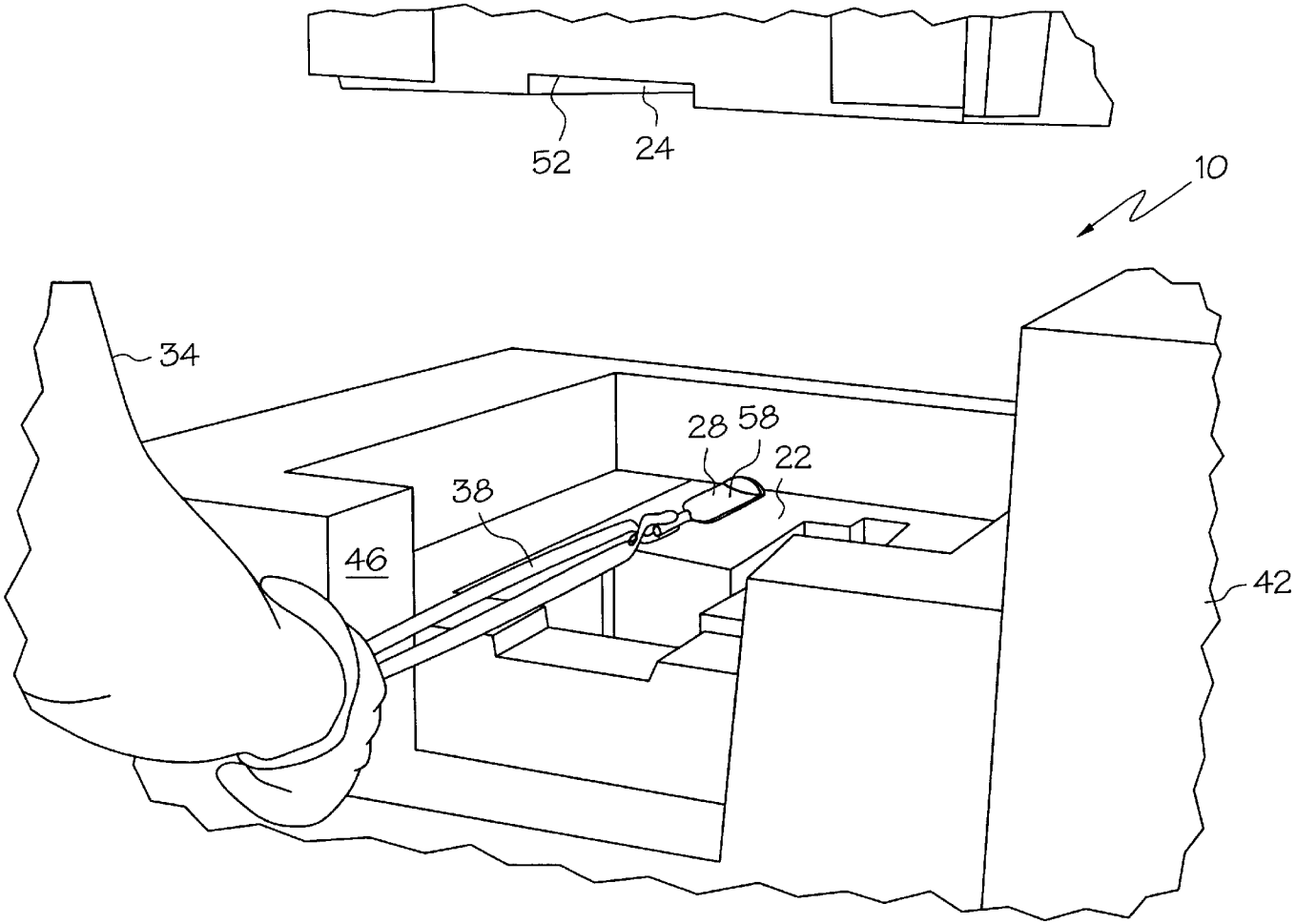
FIG. 9 is a perspective view illustration of an operator using tongs to hold the workpiece being disposed in the lower die of the forge press in FIG. 1.

Referring to FIGS. 1 and 2, the unformed workpiece 28 is heated in an oven (not shown) to a first temperature above a forging temperature and then shaped using the ram 20, also referred to as a hammer, of the forge press 10 to impact the upper die 24 on the workpiece. The unformed workpiece 28 is illustrated in FIGS. 3 and 4 as a pre-form 30 of a gas turbine engine blade having an approximate shape to that of the formed workpiece. FIG. 9 illustrates the hot pre-formed workpiece 28, which has been manually removed from the oven by an operator 34 using a tool such as tongs 38 to hold the workpiece 28, being disposed in the lower die 22. Using the tongs 38, the operator manually places the workpiece on the lower die 22 of the forge press 10 through the front 46 of the press. Though the lower die may be pre-heated, it is well below the temperature of the hot workpiece 28 and the forging temperature. In one exemplary forging operation, the forging temperature is about 1700° F. and the lower die is pre-heated to about 500° F.

The temperature of the unformed workpiece in contact with the lower die drops at a rate of about in temperature at 100° F. per second or more during a time period referred to as chill down as illustrated in FIG. 1. The relative effect on the quality of the forging process is larger, the thinner the workpiece. The operator, by pushing a start switch operably connected to a digital electronic controller 42 which controls the press 10, actuates the ram 20 to effect the impact. In the absence of any other reheating methods, the temperature of the workpiece continues to fall in a transient way until the upper die 24 of the forge press 10 impacts the workpiece 28 at the end of chill down. After impact of the upper die 24 against the workpiece 28, the temperature of the workpiece continues to fall as well until the workpiece is removed from contact with the metallic lower die 22 or until it reaches the same temperature as the lower die.

Figure 5:
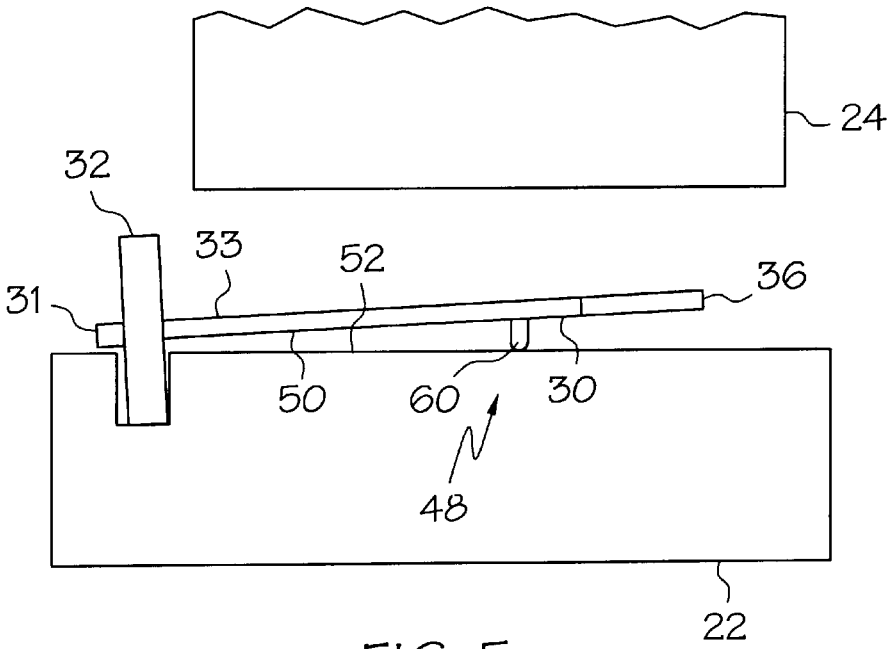
FIG. 5 is a side view schematical illustration of the blade in FIGS. 4 and 5 elevated above the lower die in FIG. 2 using protuberances on the blade.

The exemplary embodiment of the present invention includes placing the workpiece 28 on the lower die 22 such that a workpiece contact surface area 50 of the workpiece is in an elevated position above a die contact surface area 52 of the lower die. The airfoil section 33 is pivotably raised by resting the platform section 32 and/or the root section 31 on the lower die 22, thereby, spacing the workpiece contact surface area 50 above the die contact surface area 52 as illustrated in FIGS. 4 and 5. The exemplary embodiment illustrates the workpiece contact surface area 50 as being on the airfoil section 33 of the blade workpiece or pre-form 30.

The workpiece contact surface area 50 is spaced apart from and above the die contact surface area 52 of the lower die 22 during the chill down. In one embodiment, the workpiece 28 is maintained in an elevated position during the chill down with a collapsible means 48 for collapsing during the impact and allowing contact between the workpiece contact surface area 50 and the die contact surface area 52 during the impacting. In one particular embodiment, the collapsible means 48 is one or more preferably pre-formed protuberances 60 on the workpiece contact surface 50 as illustrated in FIGS. 3 and 4. The airfoil section 33 is pivotably raised by resting the platform section 32 and/or the root section 31 on the lower die 22 and elevating or spacing the workpiece contact surface area 50 above the die contact surface area 52 of the lower die with the protuberances 60.

Figure 6:
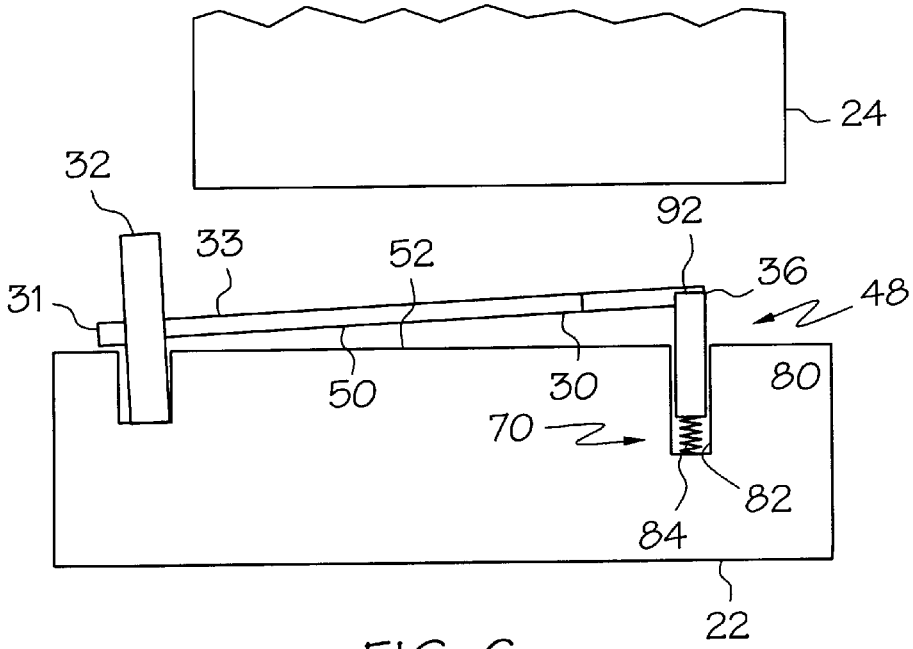
FIG. 6 is a side view schematical illustration of the blade in FIGS. 4 and 5 elevated above the lower die in FIG. 2 using a spring loaded shaft in the lower die.
Figure 8:
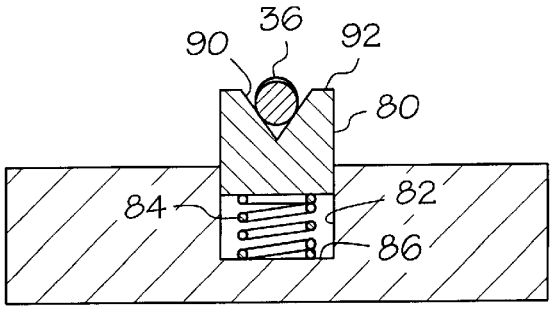
FIG. 8 is a cross-sectional view illustration of the spring loaded shaft in the lower die in FIG. 7.

In another particular embodiment, the collapsible means 48 is at least one spring-loaded means generally shown at 70 in FIGS. 6, 7, and 8 between the workpiece 28 and the lower die 22 such as a shaft 80 disposed in a bore 82 in the lower die. A spring 84 is disposed in the bore 82 between the shaft 80 and a bottom surface 86 of the bore. Note that in this embodiment, the protuberances 60 on the workpiece contact surface 50 as illustrated in FIGS. 3 and 4 are not used. A preferably V-shaped groove 90 is formed in a top 92 of the shaft 80 and the bar extension 36 is placed to rest in the groove. This helps align the workpiece 28 on the lower die for an accurate and repeatable forging process. A plurality of devices that provide collapsible means can be placed at various locations to control the heat transfer rate. Thus, for example, more than one set of protuberances or spring loaded collapsible means or any combination thereof can be used.

Actuating the ram causes the impacting of the upper die 24 against the workpiece 28 and contact between the workpiece contact surface area 50 and the die contact surface area 52 during the impacting. The protuberances 60 and the spring-loaded shaft 80, two exemplary collapsible means 48 illustrated herein, collapse under the force of the impact.

After forging the now formed workpiece 28 is removed form the forge press 10 and while still hot, it is placed onto a lower die of a trim press not shown. The trim press is used to trim off excess material such as flash from the airfoil of the formed workpiece. The trim dies are generally at room temperature. A trim process is more particularly disclosed in a co-pending U.S. patent application Ser. No. (GE DOCKET NO. 13DV-13034) which is incorporated herein by reference. Similar heat transfer reduction devices or collapsible means can be incorporated in the trim process.

While the preferred embodiment of the present invention has been described fully in order to explain its principles, it is understood that various modifications or alterations may be made to the preferred embodiment without departing from the scope of the invention as set forth in the appended claims.

What is claimed is:

1. A method for forging a workpiece using a forge press, the press having a lower die and an upper die, the upper die connected to a ram, and the workpiece having a workpiece contact surface area for contacting a die contact surface area of the lower die during impact of the upper die against the workpiece, said method comprising:

heating a workpiece to a first temperature above an impact temperature, placing the workpiece on the lower die such that a section of said workpiece rests on said lower die and the workpiece contact surface area of the workpiece is pivotably raised in an elevated position above the die contact surface area of the lower die, and actuating the ram to effect impacting of the upper die against the workpiece and contact between the workpiece contact surface area and the die contact surface area during said impacting.

2. A method as claimed in claim 1 wherein said placing the heated workpiece on the lower die in the elevated position comprises spacing the workpiece contact surface area above the die contact surface area with a collapsible means that collapses during said impacting allowing said contact between the workpiece contact surface area and the die contact surface area during said impacting.

3. A method as claimed in claim 2 wherein the collapsible means comprises at least one protuberance formed on the workpiece contact surface.

4. A method as claimed in claim 2 wherein the collapsible means comprises at least two protuberances formed on the workpiece contact surface.

5. A method as claimed in claim 4 wherein the protuberances are pre-formed on the workpiece contact surface area prior to said heating.

6. A method as claimed in claim 2 wherein the collapsible means comprises a spring-loaded means on the lower die.

7. A method as claimed in claim 6 wherein the spring-loaded means comprises at least one spring-loaded assembly, the assembly comprising a shaft disposed in a bore in the lower die and a spring disposed in the bore between the shaft and a bottom surface of the bore.

8. A method as claimed in claim 1 wherein the workpiece is a blade workpiece and includes in serial order root, platform, and airfoil sections and the workpiece contact surface area is on the airfoil section and placing includes pivotably resting the platform section on the lower die and spacing the workpiece contact surface area above the die contact surface area with a collapsible means that collapses during said impacting allowing said contact between the workpiece contact surface area and the die contact surface area during said impacting.

9. A method as claimed in claim 8 wherein the collapsible means comprises at least one protuberance formed on the workpiece contact surface on the airfoil.

10. A method as claimed in claim 8 wherein the collapsible means comprises two protuberances formed on the workpiece contact surface on the airfoil.

11. A method as claimed in claim 9 wherein the at least one protuberance is pre-formed on the workpiece contact surface area prior to said heating.

12. A method as claimed in claim 8 wherein the collapsible means comprises a spring-loaded means on the lower die.

13. A method as claimed in claim 12 wherein the airfoil section extends from the platform of the blade workpiece to a tip of the blade workpiece and a bar extension extends away from the tip and said placing includes resting the bar extension on the spring-loaded means on the lower die.

14. A method as claimed in claim 13 wherein the spring-loaded means comprises at least one spring-loaded assembly, said assembly comprising a shaft disposed in a bore in the lower die and a spring disposed in the bore between the shaft and a bottom surface of the bore and said resting includes putting the bar extension into a groove in a top of the shaft.

15. An apparatus for forming a workpiece, said apparatus comprising:

a press having spaced apart lower and upper dies, said press having a ram operably connected to said upper die, said workpiece having a workpiece contact surface area, said lower die having a die contact surface area for contacting a die contact surface area of the lower die during impact of said upper die against said workpiece, and a means for maintaining the workpiece in an elevated position above the lower die such that a section of the workpiece rests on said lower die and said workpiece contact surface area is pivotably raised in an elevated position above said die contact surface area.

16. An apparatus as claimed in claim 15 wherein said means comprises a collapsible element that collapses during the impact allowing said contact between the workpiece contact surface area and the die contact surface area during said impacting.

17. An apparatus as claimed in claim 16 wherein said collapsible element comprises protuberances on said workpiece contact surface.

18. An apparatus as claimed in claim 17 wherein said protuberances are pre-formed protuberances on the workpiece contact surface area.

19. An apparatus as claimed in claim 15 wherein said means comprises at least one spring-loaded means between the workpiece and said lower die.

20. An apparatus as claimed in claim 19 wherein said spring-loaded means comprises at least one spring-loaded assembly, said assembly comprising a shaft disposed in a bore in said lower die and a spring disposed in said bore between said shaft and a bottom surface of said bore.

21. An apparatus as claimed in claim 20 wherein:

said workpiece is a blade workpiece and includes in serial order root, platform, and airfoil sections;

said airfoil section extends from said platform to a tip of said the blade workpiece and a bar extension extends away from said tip;

said workpiece contact surface area is on said airfoil section;

said platform section pivotably resting on said lower die; and said bar extension rests on said spring-loaded means on said lower die.

22. An apparatus as claimed in claim 21 further comprising a groove in a top of said shaft and bar extension resting in said groove.

23. An apparatus as claimed in claim 22 wherein said groove is V-shaped.

* * * * *